US008182311B2

(12) United States Patent
Cooper et al.

(10) Patent No.: US 8,182,311 B2
(45) Date of Patent: May 22, 2012

(54) DEVICE FOR ABRASIVE MACHINING

(75) Inventors: Alex Cooper, Brooklyn, NY (US); Yevgeny Bederak, New York, NY (US); Richard Nastasi, Commack, NY (US); Alexander Bederak, New York, NY (US)

(73) Assignee: Universal Photonics, LLC, Hicksville, NY (US)

( * ) Notice: Subject to any disclaimer, the term of this patent is extended or adjusted under 35 U.S.C. 154(b) by 0 days.

(21) Appl. No.: 12/317,795

(22) Filed: Dec. 29, 2008

(65) Prior Publication Data

US 2012/0071072 A1 Mar. 22, 2012

(51) Int. Cl.
*B24B 55/02* (2006.01)

(52) U.S. Cl. ..... 451/7; 451/451

(58) Field of Classification Search ..... 451/450, 451/451, 454, 455, 548, 7, 53
See application file for complete search history.

(56) References Cited

U.S. PATENT DOCUMENTS 2,455,597 A * 12/1948 Metzger et al. ..... 451/548
3,153,885 A * 10/1964 Keller et al. ..... 451/450
3,609,931 A * 10/1971 Voorhies ..... 451/450
5,980,168 A * 11/1999 Tsypin et al. ..... 408/204

* cited by examiner

*Primary Examiner* — Robert Rose
(74) *Attorney, Agent, or Firm* — Henry M. Feiereisen

(57) ABSTRACT

A device for abrasive machining, comprising a substantially cup shaped to rough rotatable around an axis and having an inner chamber and a disk-shaped to working element at its one axial end; and immovable holder attachable to a machine to and surrounding at least a portion of said working element at an opposite axial end at a distance therebetween so as to form a passage for passing a cooling liquid; and a helical guiding means provided in said passage so that during rotation of said tool inside said holder the cooling liquid is supplied through the substantially helical guide into said inner chamber of said tool toward said working element.

7 Claims, 2 Drawing Sheets

DEVICE FOR ABRASIVE MACHINING

BACKGROUND OF THE INVENTION

The present invention relates to devices for abrasive machining of parts.

More particularly, it relates to devices for abrasive machining of parts which are provided with substantially cup-shaped tools having abrasive working elements or layers on its one axial side. The devices of this type are known in the art. One of the problems which are experienced in these devices is a supply of cooling liquid. Since the tool rotates it is very difficult to supply the cooling liquid from outside, and since the working element of the tool machines a corresponding part from inside, it is also difficult to supply the cooling liquid inside the tool. It is believed that the existing devices of this type can be improved.

SUMMARY OF THE INVENTION

Accordingly, it is an object of the present invention to provide a device for abrasive machining of parts which is a further improvement of the existing devices.

In keeping with these objects and with others which will become apparent hereinafter, one feature of the present invention resides, briefly stated, in a device for abrasive machining, comprising a substantially cup shaped to rough rotatable around an axis and having an inner chamber and a disk-shaped to working element at its one axial end; and immovable holder attachable to a machine to and surrounding at least a portion of said working element at an opposite axial end at a distance therebetween so as to form a passage for passing a cooling liquid; and a helical guiding means provided in said passage so that during rotation of said tool inside said holder the cooling liquid is supplied through the substantially helical guide into said inner chamber of said tool toward said working element.

Another feature of the present invention resides, briefly stated, in a helical means is provided on a radially outer surface of said tool adjoining said passage.

Still a further feature of the present invention resides, briefly stated, in a helical means is provided on a radially inner surface of said holder adjoining said passage.

A further feature of the present invention resides, briefly stated said helical means are provided on a radially outer surface of said tool and on the radially inner surface of said holder both adjoining said passage.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
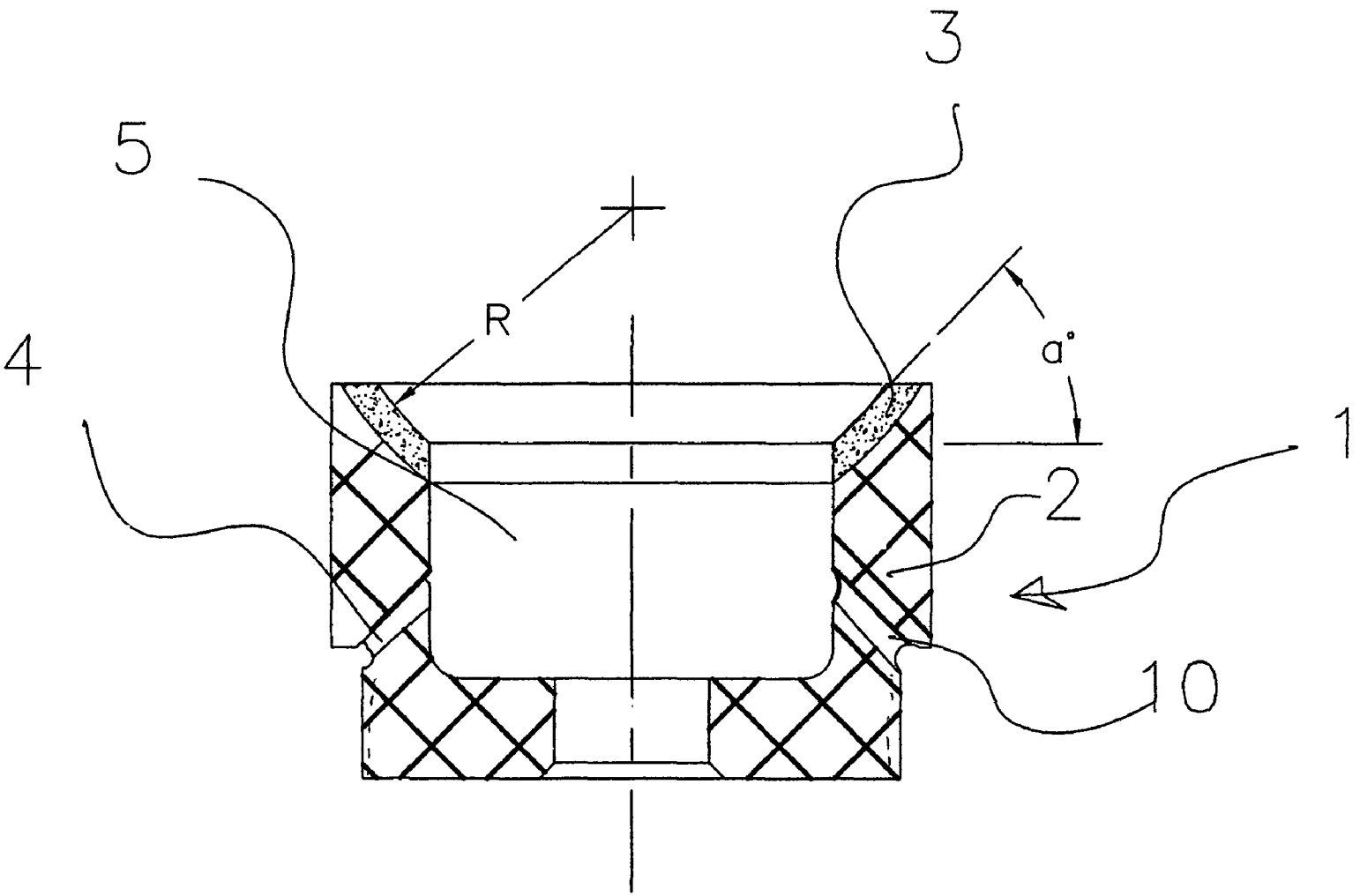
FIG. 1 is a view showing an abrasive tool of the device for abrasive machining of parts in accordance with the present invention.

A device for abrasive machining of parts in accordance with the present invention has an abrasive tool which is identified as a whole with reference numeral 1. The abrasive tool 1 is substantially cup shaped it includes a substantially cup shaped support 2 having an axis A and an abrasive working layer 3 which is attached to the support at one of its axial ends, and can be for example concave. The working element or layer 3 can be composed of a plurality of abrasive grains which are accommodated in a corresponding binder.

Figure 2:
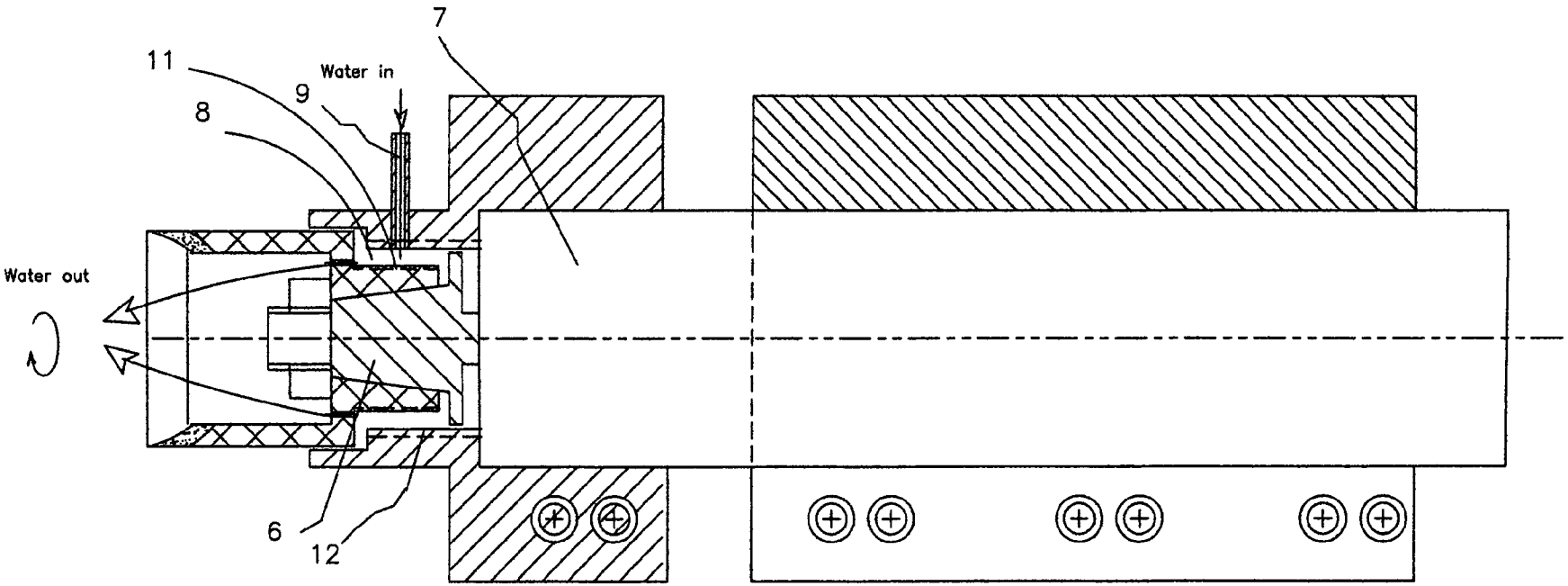
FIG. 2 is a view showing a device for abrasive machining of parts provided with the abrasive tool which is retained in a holder immovably attachable to a machine tool.

In the abrasive tool in accordance with the present invention at least one throughgoing opening 4 is provided which extends from outside of the support into an inner chamber 5 formed inside the support. It is to be understood that a plurality of throughgoing openings can be provided. In FIG. 1 the openings are inclined to the axis of rotation A of the tool, while in FIG. 2 the openings are shown as extending substantially in an axial direction.

The tool 1 has an axial hole with which it is fitted on a spindle 6 which is rotatable by a machine tool so that the abrasive tool 1 rotates together with the rotary spindle 6. The hole and therefore the connection of the tool of the rotary spindle is provided in the axial opposite end of the support, as opposed to the axial end which the working element 3 is arranged.

A holder 7 is immovably connected to the machine tool, for example by screws. The holder, and in particular its portion extending to the left in FIG. 2 radially surrounds the rear portion of the tool 1 so as to retain a passage therebetween. Cooling water is supplied through a pipe 9 extending through the wall of the holder and opening into the passage 8

During the operation when the spindle is rotated by the machine tool, the abrasive tool 1 rotates and provides machining of a part with its working element 3. At the same time the cooling water is supplied through the pipe 9 into the passage 8 and through the throughgoing holes into the inner chamber of the tool 1 and then to a working area between the abrasive working element 2 and the machine part.

In accordance with the present invention, in order to improve the cooling liquid supply the passage 8 is provided with a helical guide. As shown in FIG. 1, the helical guide which is identified here with reference numeral ills provided on an outer surface of the rear part of the support 2 of the tool 1 and its direction of helix is selected so that during rotation of the tool 1 the water is entrained in and supplied by the helical guide 11 to the left in FIG. 2 and then through the throughgoing openings to the interior of the tool 1.

In accordance with another embodiment of the present invention, the helical guide 12 can be provided on a radially inner surface of the holder adjoining the passage 9. It also enhances the cooling water supply through the throughgoing openings into the interior of the tool 1.

It should be mentioned that the opening of the pipe 10 is provided in a middle area of the passage between its opposite axial ends.

With such location of the opening of the pipe, in the region which is located at the left side of the pipe the cooling water is pumped toward the inner space of the tool 1 and the cooling water at the right side of the opening of the pipe is sucked by the helical guide to be supplied in the same direction toward the inner chamber of the tool and not toward the spindle.

It is believed that in accordance with the present invention both helical guides 11 and 12 can be utilized, and provided in the corresponding radially outer surface of the tool 1 and the radially inner surface of the holder 11, both adjoining the passage 10.

The helical passages can be formed by forming threads of the corresponding radially inner and radially outer surfaces adjoining the passage 10.

It will be understood that each of the elements described above, or two or more together, may also find a useful application in other types of constructions differing from the type described above.

While the invention has been illustrated and described as embodied in a device for abrasive machining, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A device for abrasive machining, comprising a substantially cup shaped tool rotatable around an axis and having an inner chamber and a working element at its one axial end; and immovable holder attachable to a machine and surrounding at least a portion of said tool at a distance therebetween so as to form a passage for passing a cooling liquid; and a helical guiding means provided in said passage so that during rotation of said tool inside said holder a cooling liquid is supplied through said helical guide means into said inner chamber of said tool toward said working element wherein said helical guide means is provided on a radially inner surface of said holder adjoining said passage.

2. A device for abrasive machining, comprising a substantially cup shaped tool rotatable around an axis and having an inner chamber and a working element at its one axial end; and immovable holder attachable to a machine and surrounding at least a portion of said tool at a distance therebetween so as to form a passage for passing a cooling liquid; and a helical guiding means provided in said passage so that during rotation of said tool inside said holder a cooling liquid is supplied through said helical quide means into said inner chamber of said tool toward said working element, wherein said helical means are provided on a radially outer surface of said tool and on a radially inner surface of said holder both adjoining said passage.

3. A device as defined in claim 1; and further comprising communicating means for communicating said passage with said inner chamber.

4. A device as defined in claim 1, wherein said communicating means include at least one throughgoing opening provided in said tool.

5. A device as defined in claim 4, wherein said at least one throughgoing opening extends in an axial direction.

6. A device as defined in claim 4, wherein said at least one thoroughgoing opening is inclined to said axial direction.

7. A device as defined in claim 1; and further comprising a cooling liquid supply element having an outlet opening which opens into said passage in an area between its opposite axial ends to provide a pumping action and a suction action for the cooling liquid.

* * * * *